US007117808B2

(12) United States Patent
Kulikov et al.

(10) Patent No.: US 7,117,808 B2
(45) Date of Patent: Oct. 10, 2006

(54) SYSTEM FOR TRANSFERRING LIQUID LOAD, MAINLY OIL TO A TANKER

(76) Inventors: Nikolai Vladimirovich Kulikov, Zlatoustinsky pereulok, 3a-62, Moscow (RU) 101000; Vyacheslav Vladimirovich Ruksha, Mozhaiskoehosse, 36-17, Moscow (RU) 121471

( * ) Notice: Subject to any disclaimer, the term of this patent is extended or adjusted under 35 U.S.C. 154(b) by 0 days.

(21) Appl. No.: 10/509,432

(22) PCT Filed: Jul. 1, 2002

(86) PCT No.: PCT/RU02/00315

§ 371 (c)(1),
(2), (4) Date: Jun. 13, 2005

(87) PCT Pub. No.: WO03/082664

PCT Pub. Date: Oct. 9, 2003

(65) Prior Publication Data

US 2005/0235897 A1 Oct. 27, 2005

(30) Foreign Application Priority Data

Mar. 29, 2002 (RU) ..... 2002108113

(51) Int. Cl.
*B63B 21/00* (2006.01)

(52) U.S. Cl. ..... 114/230.1; 441/4

(58) Field of Classification Search ..... 114/230.1, 114/230.26; 441/3, 4, 5
See application file for complete search history.

(56) References Cited

U.S. PATENT DOCUMENTS 4,587,919 A 5/1986 Loire et al.

(Continued)

FOREIGN PATENT DOCUMENTS

FR 2219053 9/1974

(Continued)

*Primary Examiner*—Lars A. Olson
(74) *Attorney, Agent, or Firm*—patenttm.us; James H. Walters

(57) ABSTRACT

The invention can be used for a off-shore discharge of a liquid load, mainly oil from a land storage plant to ocean-going tankers during winter time and initial ice formation when the thickness of a stable fast ice is equal to or less than 1.5 m. In the first variant, the inventive system for transferring a liquid load to a tanker comprises an ice breaker (6) moored to a mooring berth, a tanker (1) moored by the fore (8) thereof directly or at a distance to the icebreaker's stem (7), a service ship (9) disposed on the side of the stern of said tanker, a device for protecting the flexible hose (5) of a pipeline (3) against ice and a handling gear for transferring said flexible hose (5) from the icebreaker (6) to the tanker (1) which are arranged in the afterdeck of the icebreaker (6), a diving well (22) arranged in the hull of said icebreaker and provided with a diving station (21) and a service well (12) which is arranged in the afterdeck of the icebreaker (6). The device for protecting the flexible hose is embodied in the form of a cylinder (11) provided with guides (15) which make it possible to move inside the service well (12), the lower side (16) of said cylinder being disposed below the edge of floating ice. In the second variant of the system for transferring a liquid load to a tanker (1), the device for protecting the flexible hose (5) of a pipeline (3) against ice is embodied in the form of a pontoon (29), provided with a well (30) for servicing the flexible hose (5) and arranged for sea on the deck of the icebreaker (6).

8 Claims, 12 Drawing Sheets

U.S. PATENT DOCUMENTS

| | | | | | |
|---|---|---|---|---|---|
| 4,604,961 | A | * | 8/1986 | Ortloff et al. | 114/230.12 |
| 4,617,000 | A | * | 10/1986 | Girardot et al. | 441/3 |
| 4,648,848 | A | * | 3/1987 | Busch | 441/5 |
| 6,162,105 | A | | 12/2000 | Breivik | |

FOREIGN PATENT DOCUMENTS

| | | |
|---|---|---|
| GB | 2297530 | 8/1996 |
| RU | 2119874 | 10/1998 |

* cited by examiner

SYSTEM FOR TRANSFERRING LIQUID LOAD, MAINLY OIL TO A TANKER

This invention relates to ship-building and may be used in systems intended for transferring a liquid cargo, mainly oil, for the most part from land to a tanker.

At present, due to an increase in oil consumption, its production at off-shore fields both abroad and in the Russian Federation (the Barents Sea, the Sea of Okhotsk) has becoming more intensive. Thus, in the Russian Federation, in the Timano-Pechora Province rich oil fields has been discovered, such as the Varandeiskoye field, the Toraveiskoye field, etc. Severe climatic conditions are typical for this province: the cold winter period with negative temperatures and ice formation on the Pechora Sea lasts from November till May. Such climatic conditions put forward new requirements to systems for transferring oil from land to a tanker, which should be able to ship oil not only in the short warm period, but also during the long cold period of time.

Known in the art is a device for transferring liquid media to a tanker, which comprises a movable system of rigid tubes connected in series with the use of joints for the purpose of providing a U-shaped compensator, wherein one joint being installed at each end section of the compensator, one joint—in its medium part, the end sections of the compensator are connected with the transportation pipe for liquid media, the joints of the said U-shaped compensator being of ball type (USSR Inventor's Certificate No. 1159827 for the invention "A device for transferring a liquid medium to a tanker" IPC (4) B63B27/24, Application filed on 13 Jul. 1983, application No. 3620266/27-11, pub on 7 Jun. 1985. Bulletin No. 21).

A liquid medium is transferred from land to a tanker via a berth attached by anchors to the ground and capable of moving under the action of wind and stream in the horizontal direction and under the action of tidal changes in the sea level in the vertical direction. In order to transfer a liquid medium ball joints are attached to a tube rigidly fixed to the berth and to a tube rigidly fixed on land and connected with a reservoir; such joints enable to change the distance between the said tubes in the process of operation by their tuning around the respective axes. The liquid medium is transferred similarly (through a system of rigid tubes) from the floating berth to a tanker moored to it.

The said device neither has sufficient reliability in the process of operation due to rapid tear and wear of ball surfaces of the ball joints, which may lead to oil leakages, nor enables to transfer a liquid medium in the winter time in the conditions of ice formation.

Known in the art is a complex for transferring liquid cargoes to non-equipped shore, which comprises a tanker with the fore ramp, a towboat (amphibious boat), a point floating berth with an anchor, underwater and floating hoses and with risers connected to each other and to the said anchor by universal joints, a floating reel for reeling the underwater hose, a winch with cable-and-block route for raising and lowering the said floating berth (RF Patent No. 2006420 for the invention "A complex for transferring liquid cargoes to non-equipped shore" IPC (5) B63B27/30. Application filed on 6 May 1991, Application No. 494366/11, published on 30 Jan. 1994, Applicant—TsKB "Shell", patent owner—I. V. Sumskoy).

After a tanker comes to the area of unloading, the anchor under its own weight drops into water and opens. The towboat and the floating reel with the reeled underwater hose are launched, the free end of the latter is connected to the berth pipeline system, which is anchored. The amphibious boat, while moving to the shore, tows the floating reel, the underwater hose is being unreeled and laid on the sea bed. When on the shore, the amphibious boat rolls the floating reel, and its end is connected to the consumer of oil products.

The said complex, first, provides for only transfer of oil from a tanker to non-equipped shore. Second, the complex, especially the oil transfer system itself, is distinguished by complexity and low reliability due to multiple operations of reeling and unreeling the flexible hose and possible damages of the latter during its laying onto the sea bed. The known complex, third, may not be applied for transferring oil in the winter time in the conditions of ice formation.

On the basis of an analysis of the information about the state of the art in this field, from the known complexes and tanker systems for transferring a liquid cargo to a tanker the closest is the tanker system for loading or unloading a liquid medium, in particular oil, to a tanker; the said system comprises the open down receiving housing with a locking mechanism arranged in it, serving for providing a detachable connector in the receiving void of a buoy, which is installed on anchors on the sea bed and connected with at least one transferring pipeline for transportation of a liquid medium, the said receiving housing being completely arranged in the submerged part of the tanker's fore side and connected with the tanker's deck by the service well made with the possibility of passing through it the cable of the lifting device lowered through the receiving housing for the purpose of being connected to the buoy and raising the latter to the housing (RF Patent No. 21119874 for the invention "A tanker system for loading and unloading a liquid medium to/from the tanker". IPC (6) B63B 27/00. Application filed on 30 Mar. 1992, Application No. 94027292/28. Conventional priority from 27 Nov. 1991, No. 914652, Norway. Published in the Russian Federation on 10 Oct. 1998. Patent Owner—Den Norske Stats Olieselskap AS (Norway)—prototype).

The known system is arranged onboard the tanker and is intended for carrying out handling operations through an underwater buoy, which is connected to the tanker in the receiving housing located in the tanker. A liquid medium is transported from the buoy to tanks or from the latter to the tanker.

The known system ensures unloading and loading liquid media from/to a tanker at unfavorable weather conditions. But, it cannot ensure transfer of oil in the winter time, in ice conditions (finely broken initial ice, stable fast ice). Moreover, the oil transfer system itself is associated with high danger related to loading operations carried out directly in the hull of a tanker. The known system is also not very reliable, since a subsurface buoy may be damaged by passing tankers and other floating facilities in shallow waters.

Thus, as the analysis of the found information about the state of the art has shown, the known tanker systems and the complexes for transferring oil to tankers are suitable only for handling operations in the summer time. Furthermore, the known systems for loading and unloading oil to/from tankers, as suitable for warm periods, may not be used for loading oil in cold periods of time, during the period of initial ice formation and stable fast ice.

The complex, as claimed, for transferring liquid cargoes, mainly oil, to tankers enables to reach a new technical result, that is, to ensure offshore shipments of liquid cargoes, mainly oil, from an onshore tank battery to sea-going tankers in the winter time in the conditions of initial ice formation and stable fast ice.

The following totality of essential features characterizes the essence of the claimed invention (its embodiments) and makes for achieving a new technical result.

First Embodiment

The complex for transferring a liquid cargo, mainly oil, to a tanker, comprising an offshore mooring berth with anchors, a transferring underwater pipeline with a manifold to which a flexible hose is connected for connecting the tanker with the underwater pipeline, a lifting device with a cable, a service well installed with the possibility of passing the cable of the said lifting device through it and with the possibility of access to its upper part, characterized in that the complex is equipped with an ice-breaker moored to the offshore berth, to the stem of which the tanker is moored with her fore directly or at a distance, a service boat installed on the stem side of the latter, and arranged in the ice-breaker's afterdeck a device for the protection of the pipeline flexible hose against ice action, a handling device for transferring the flexible hose from the ice-breaker to the tanker, and a diving well and a diving station, the said service well being arranged in the hull of the ice-breaker's stern side, the said device for the protection of the flexible hose being made in the form of a cylinder provided with guides for the possibility of moving inside the said service well and which lower edge in the operation position being arranged lower than the base of floating ice.

The technical result is achieved also due to the fact that the upper part of the well is equipped with a device for fixing the flexible hose, an anti-icing device, and in the travel position is made with a closing device and the flexible hose is equipped with a quickly detachable device with a locking mechanism.

Second Embodiment

The complex for transferring a liquid cargo, mainly oil, to a tanker, comprising an offshore mooring berth with anchors, a transferring underwater pipeline with a manifold to which a flexible hose is connected for connecting the tanker with the underwater pipeline, a lifting device with a cable, characterized in that the complex is equipped with an ice-breaker moored to the offshore berth, to the stem of which the tanker is moored with her fore directly or at a distance, a service boat installed on the stern side of the latter, and arranged in the ice-breaker's hull a diving well and a diving station, and arranged in the travel position a device for the protection of the flexible hose against ice action is made in the form of a pontoon having a well for servicing the flexible hose.

The technical result is also achieved due to the fact that the complex is equipped with a mechanism, as installed on the ice-breaker's deck, for lowering and raising the pontoon.

Thus, as the analysis of the found information about the state of the art in this field and the essence of the claimed invention, the latter complies with the patentability criterion of novelty.

The availability in the complex for transferring a liquid cargo, mainly oil, the offshore berth with anchors, the transferring underwater pipeline with the manifold, to which the flexible hose is connected for the purpose of connecting a tanker with the underwater pipeline, the lifting device with the cable, the service well arranged with the possibility of passing through it the cable of the said lifting device and with the possibility of accessing its upper part, enables to transfer a liquid cargo from the shore through the underwater pipeline to a tanker during the warm period only. The addition of an ice-breaker moored to the offshore berth, to the stern of which the tanker is moored with her fore side directly or at a distance, and a service boat moored from the stem side of the latter creates the necessary conditions for transferring a liquid cargo to a tanker in the winter time, in the conditions of initial ice formation and stable fast ice.

The provision of the complex with a diving well and a diving station, as installed in the hull of the ice-breaker, enables a diver to go underwater from the ice-breaker for carrying out the works on raising the flexible hose of the underwater pipeline from the sea bed.

The provision of the complex with a device, as arranged on the afterdeck of the ice-breaker, for protecting the flexible hose from ice during lowering and raising operations and transferring a liquid cargo, which is made in the form of a cylinder provided with guides for the possibility of moving inside the service well located in the hull of the ice-breaker's stern, enables to move the flexible hose of the pipeline inside the cylinder from the sea bed to the ice-breaker's deck and back. Thus, the reliable protection of the flexible hose is ensured against damaging by floating ice and against twisting during lowering and raising operations and while transferring oil.

The location of the lower side of the cylinder in the operation position lower than the base of floating ice also prevents the flexible hose from being damaged by ice and contributes to the reliable and safe lowering and raise of the flexible hose from the sea bed to the ice-breaker and back, as well as during the whole time of transferring oil.

The provision of the complex with a handling device, as arranged on the afterdeck of the ice-breaker, for transferring the flexible hose from the ice-breaker to the tanker ensures the possibility of transferring the flexible hose when carrying works on transferring oil transported from the shore through the underwater pipeline and through the flexible hose to the tanker.

The provision of the upper part of the well with a means for fixing the flexible hose, jointly with the other features, contributes to achieving the set technical result, i.e., offshore shipping of a liquid cargo, mainly oil, from the onshore tank battery to sea-going tankers in the winter time in the conditions of initial ice formation and stable fast ice.

The provision of the well with a anti-icing device precludes icing of both the well and the cylinder arranged inside it, and this ensures the reliable operation of the complex.

The making of the well in the travel position with the closing means also contributes to the achievement of the set result.

Thus, the claimed totality of the essential distinctive features of the first embodiment of the claimed invention contributes to the achievement of a new technical result.

The provision of the complex for transferring a liquid cargo, mainly oil, to a tanker with a device, as arranged on the ice-breaker's deck, for protecting the flexible hose of the pipeline against ice action, which device being made in the form of a pontoon having the well for servicing the flexible hose, ensures the protection of the latter against finely broken ice during lowering and raising the hose from/to the ice-breaker and back as well as during transferring oil from the pipeline through the flexible hose to a tanker in the winter time in the conditions of initial ice formation, which also contributes to the achievement of the set new technical result.

Thus, the claimed new totality of the essential distinctive features in both the first embodiment and the second embodiment enables to achieve a new technical result, i.e., to ensure offshore shipping of a liquid cargo, mainly oil, from the onshore oil tank battery to sea-going tankers in the winter time in the conditions of initial ice formation and stable fast ice.

In the process of the information search conducted by the applicant only individual distinctive features of the claimed invention have been found among the known objects of the same purpose, namely:

1) The service well (see RF Patent No. 2119874) according to its purpose and function is analogous to the claimed one; see also RF Patent No. 2147334—the rotating tower, but the form of its making and its function are different from those used in the claimed invention.

2) The pontoon (see USSR Inventor's Certificates Nos. 1011499, 846498, 618308), but the function and the purpose of these solutions differ from those used in the claimed invention.

3) The protective devices (see USSR Inventor's Certificate No. 1751043—in the tanker's hull a square hatch is made; USSR Inventor's Certificate No. 1093611—a protective ring). But the form, purpose and functions of the known protective devices differ from those used in the claimed invention.

4) The devices for transferring a flexible hose from a tanker to another tanker for the purpose of transferring a liquid cargo (see USSR Inventor's Certificate Nos. 716902, 1798246).

5) The guiding cylinder with guiding elements for moving inside the well and guiding a buoy (see RF Application No. 95107661, IPC B63B 22/02 for the invention "A device for guiding a submerged loading and unloading buoy in the receiving space in the tanker's bottom"). But its function is different than in the claimed invention.

Furthermore, in the state of the art no other distinctive features have been found; their forms, arrangement as well as most identified features have other purposes, functions and forms; equally, no totality of the essential distinctive features of the claimed invention has been found in the course of the search conducted. Thus, on the basis of the analysis of the found information about the state of the art in this field and the analysis of the totality of the essential distinctive features of the claimed invention, the latter does not clearly follows from the state of the art. Consequently, the claimed invention possesses the patentability criterion of inventive step.

The complex for transferring a liquid cargo, mainly oil, to a tanker (Embodiments 1 and 2) is explained with the use of the drawings, where:

FIG. 1 shows the claimed complex.

According to the first embodiment:

Figure 5:
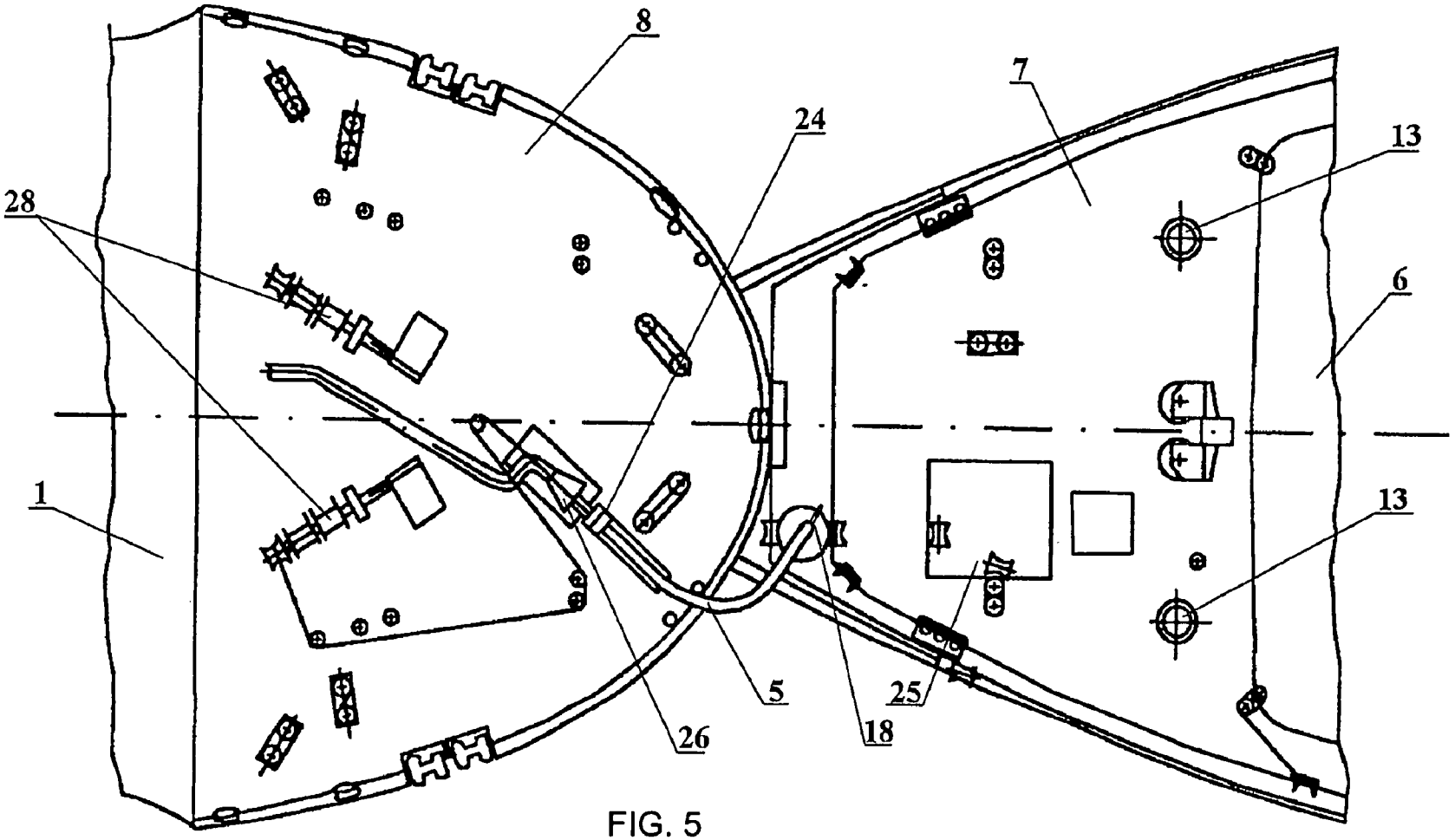
Figure 6:
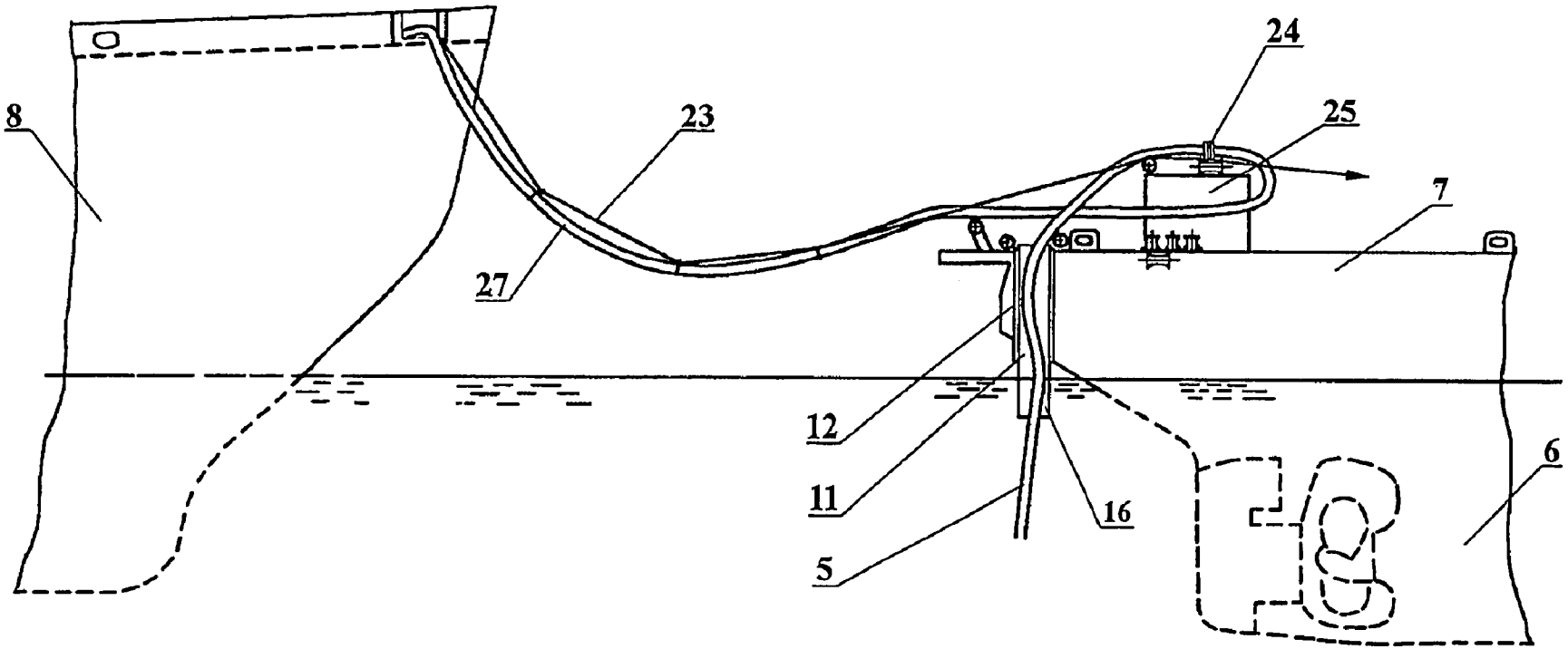
Figure 7:
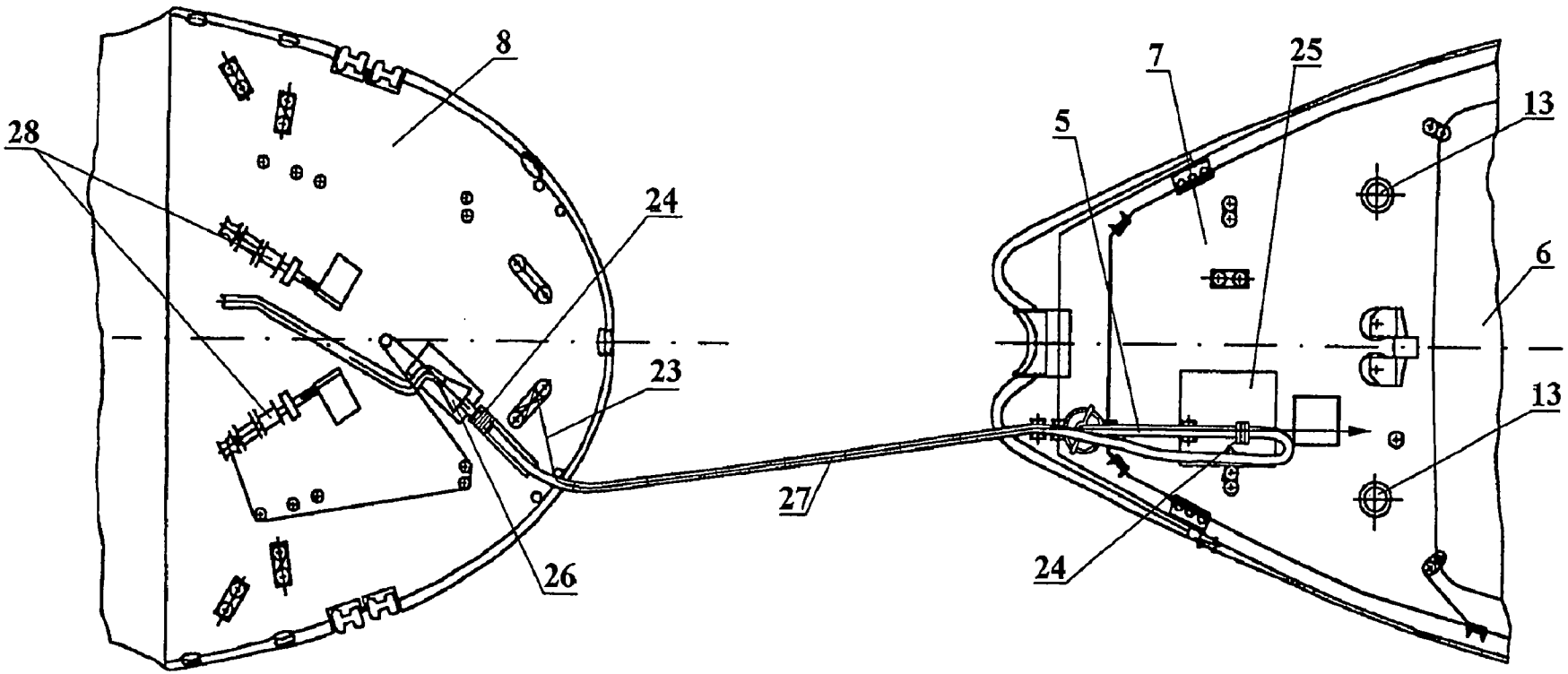

FIG. 5—same, top view;

FIG. 6 shows the scheme of transferring the hose to a tanker through the ice-breaker's tube when the tanker is located at a distance of app. 15 m from the ice-breaker's stern, side view;

FIG. 7—same, top view.

Figure 8:
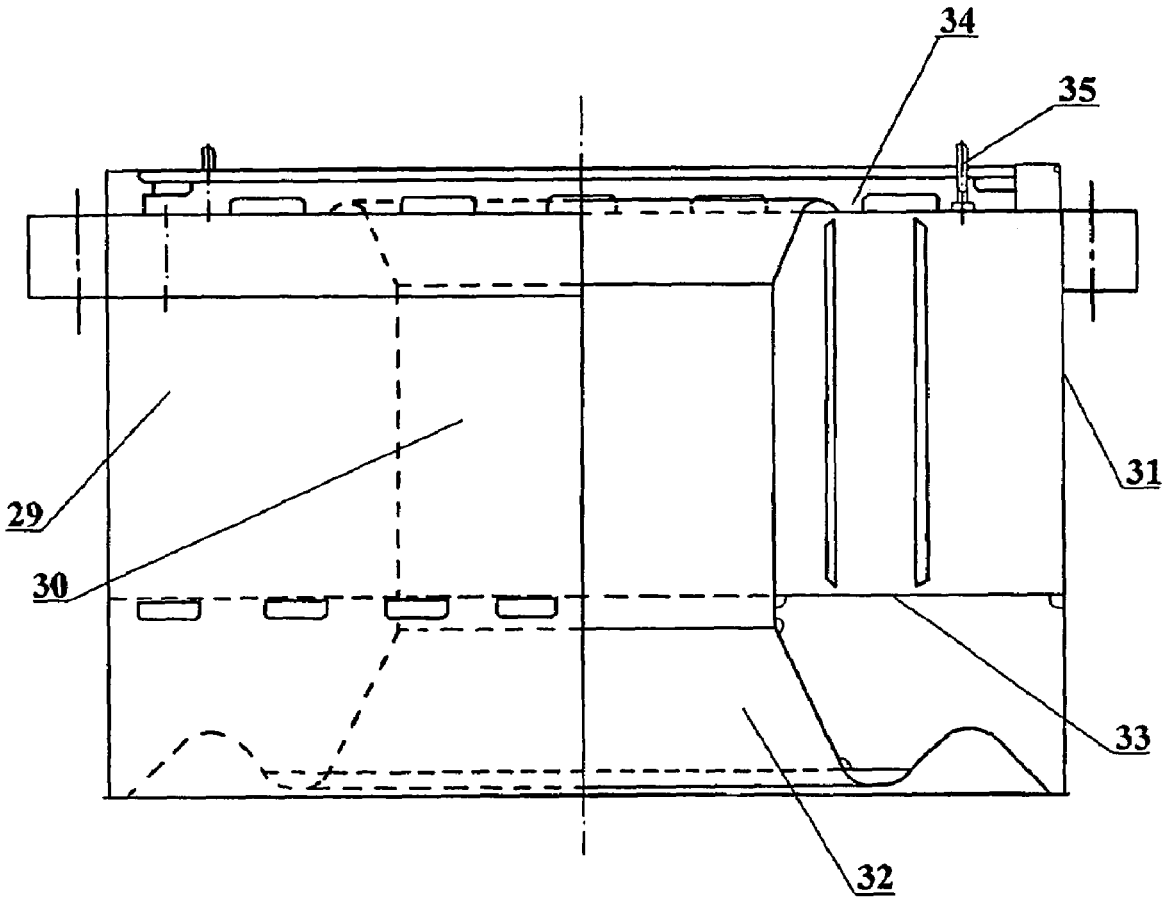
Figure 9:
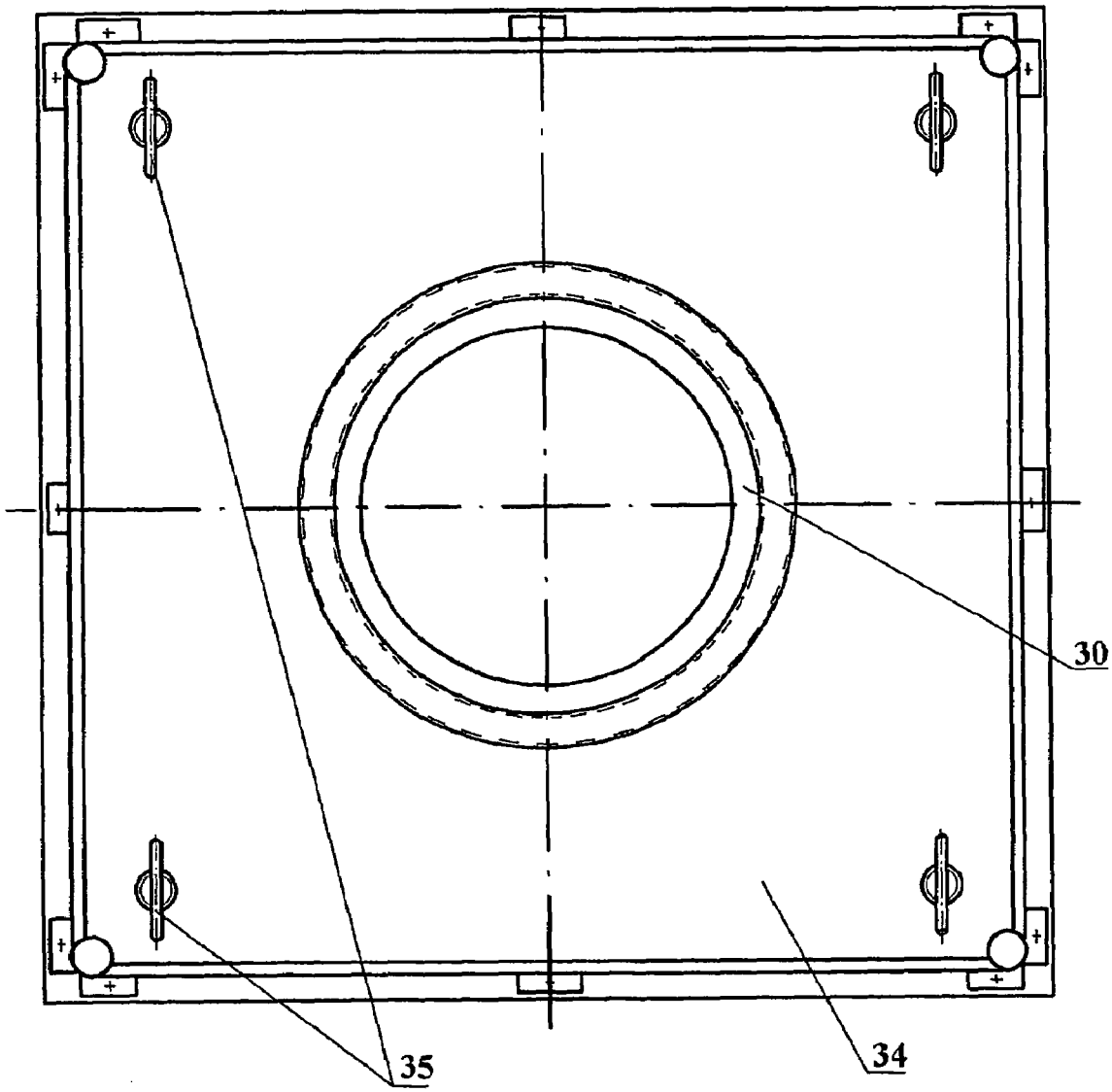
Figure 10:
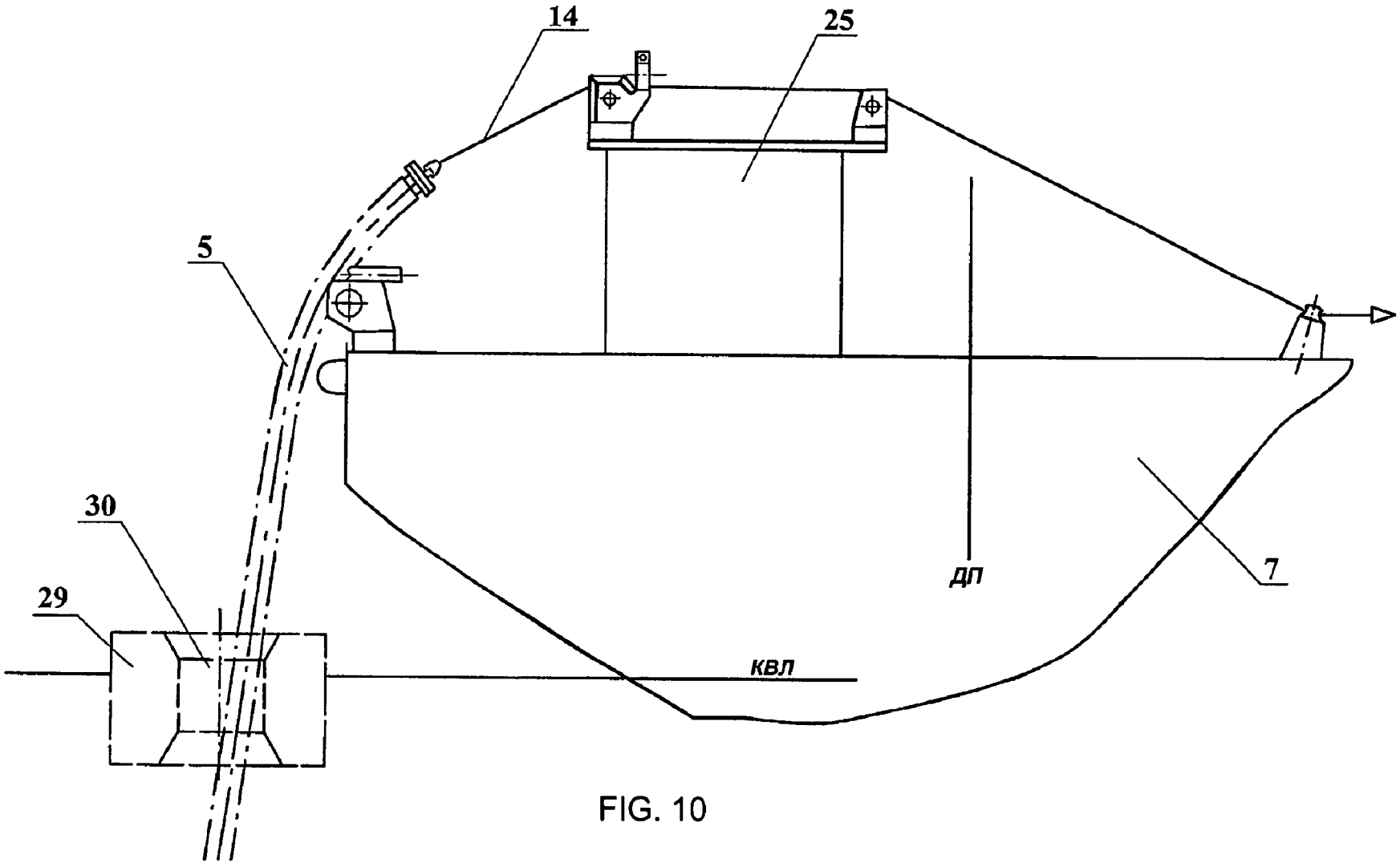
Figure 11:
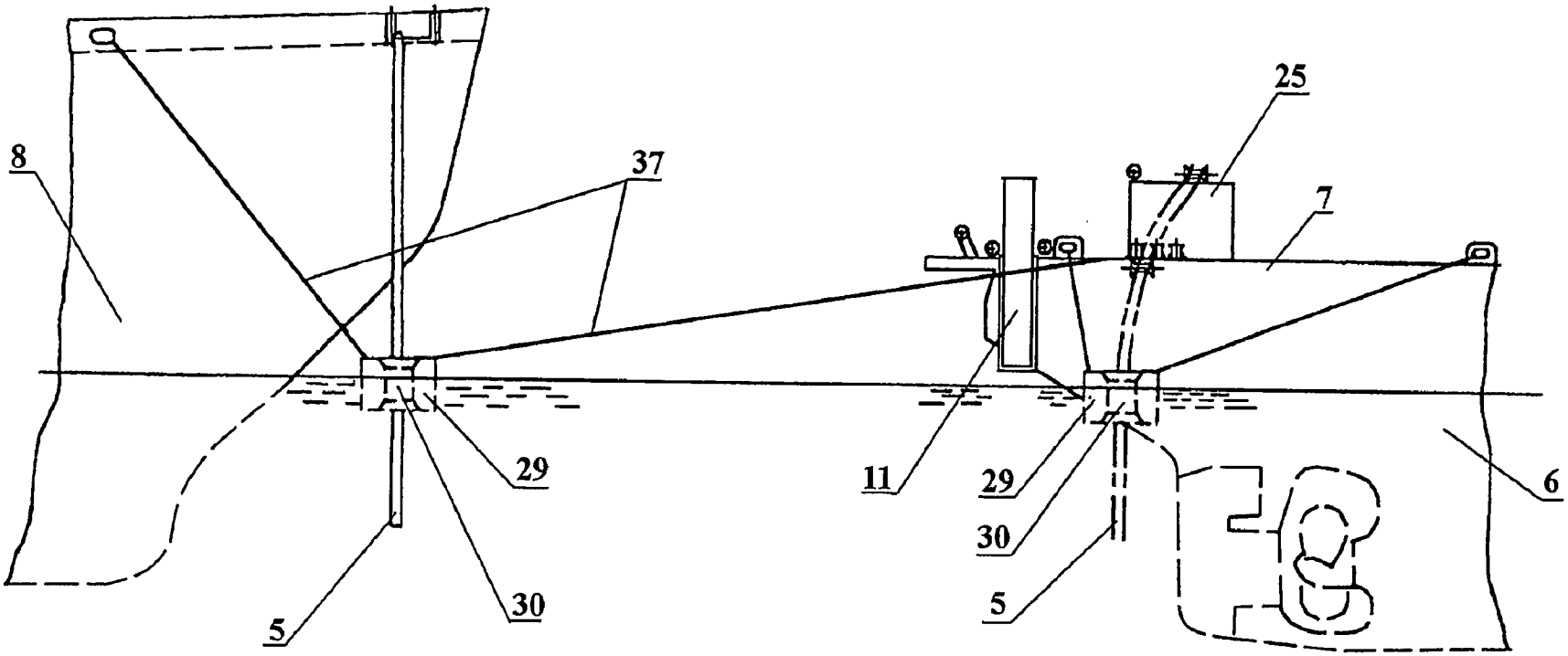
Figure 12:
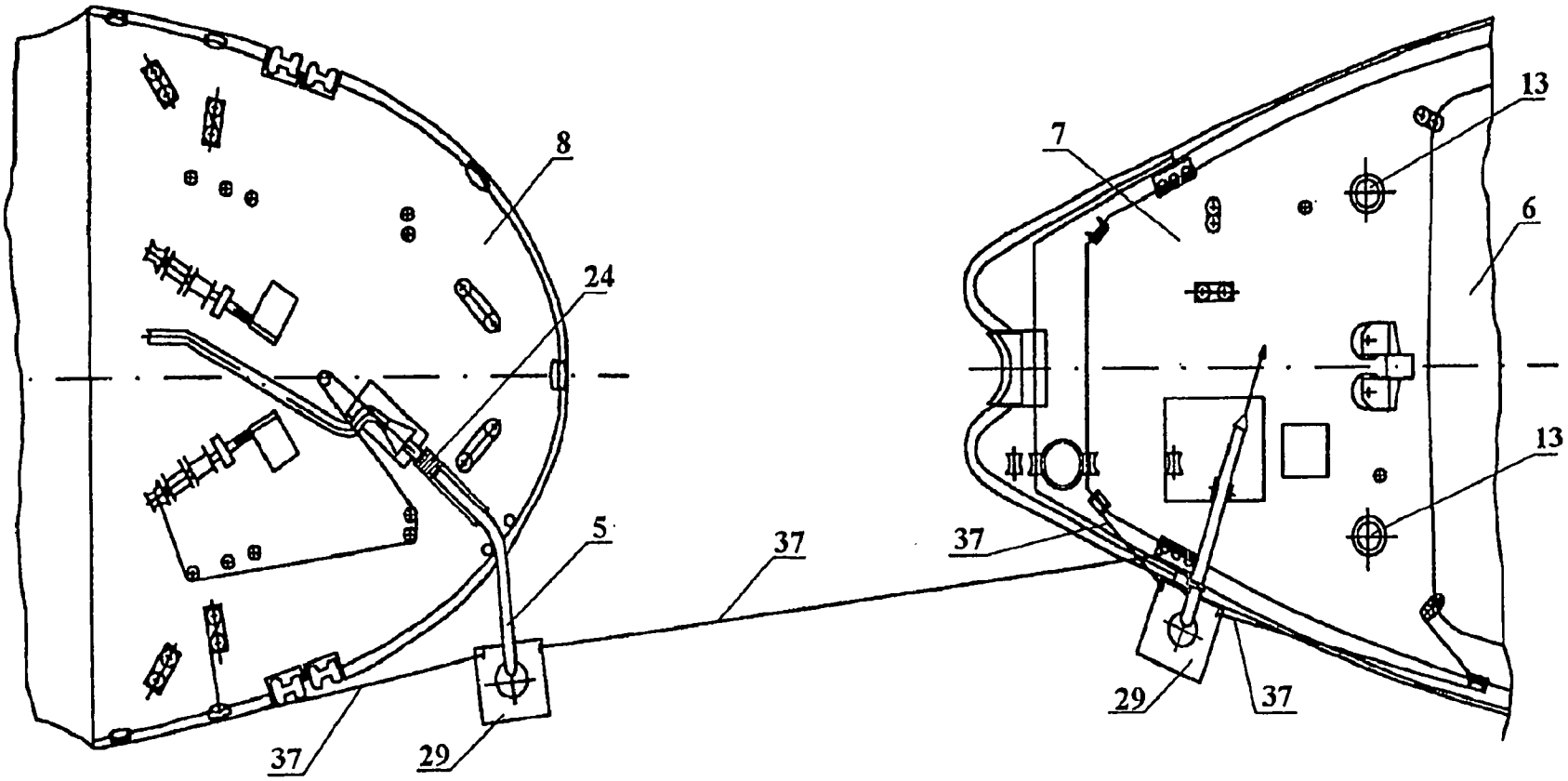

According to the second embodiment:

FIG. 8 shows the device for protecting the hose of the pipeline, which is made in the form of a pontoon, side view;

FIG. 9—same, top view;

FIG. 10 shows the scheme of transferring the flexible hose from the pontoon to the ice-breaker;

FIG. 11 shows the scheme of transferring the flexible hose from the pontoon to the tanker, side view;

FIG. 12—same, top view.

Figure 1:
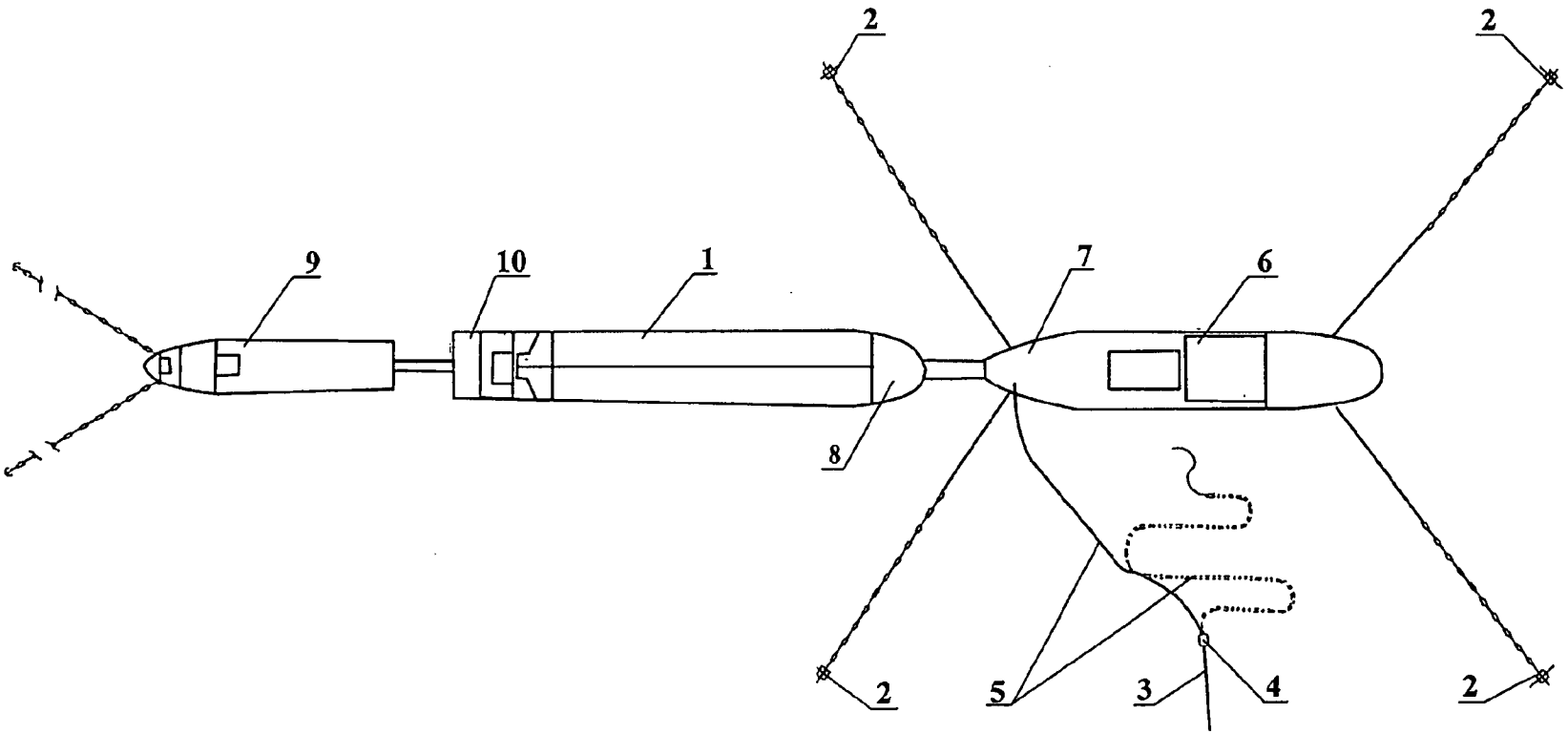

The complex for transferring a liquid cargo, mainly oil, to the tanker 1 (see FIG. 1) comprises the offshore berth made in the form of four prismatic anchors 2, deepened into the sea bed, the transferring underwater pipeline 3 with the manifold 4 equipped with a valve (not shown). To the manifold 4 the flexible hose 5 with the head (not shown) is connected, which connects the tanker 1 to the underwater pipeline 3. The ice-breaker 6 is moored with the use of the anchors 2 to the offshore berth, and to the stem 7 of the ice-breaker 6 directly or at a distance the tanker 1 is moored by her fore side (the mooring line is not shown). From the side of the stern 10 of the tanker 1 the service boat 9 is positioned for preventing the tanker from moving. The service boat 9 is made in the form of a towboat, e.g., of Neftegaz type.

For quick search of the anchors 2 they are indicated by ice buoys (now shown).

First Embodiment

Figure 2:
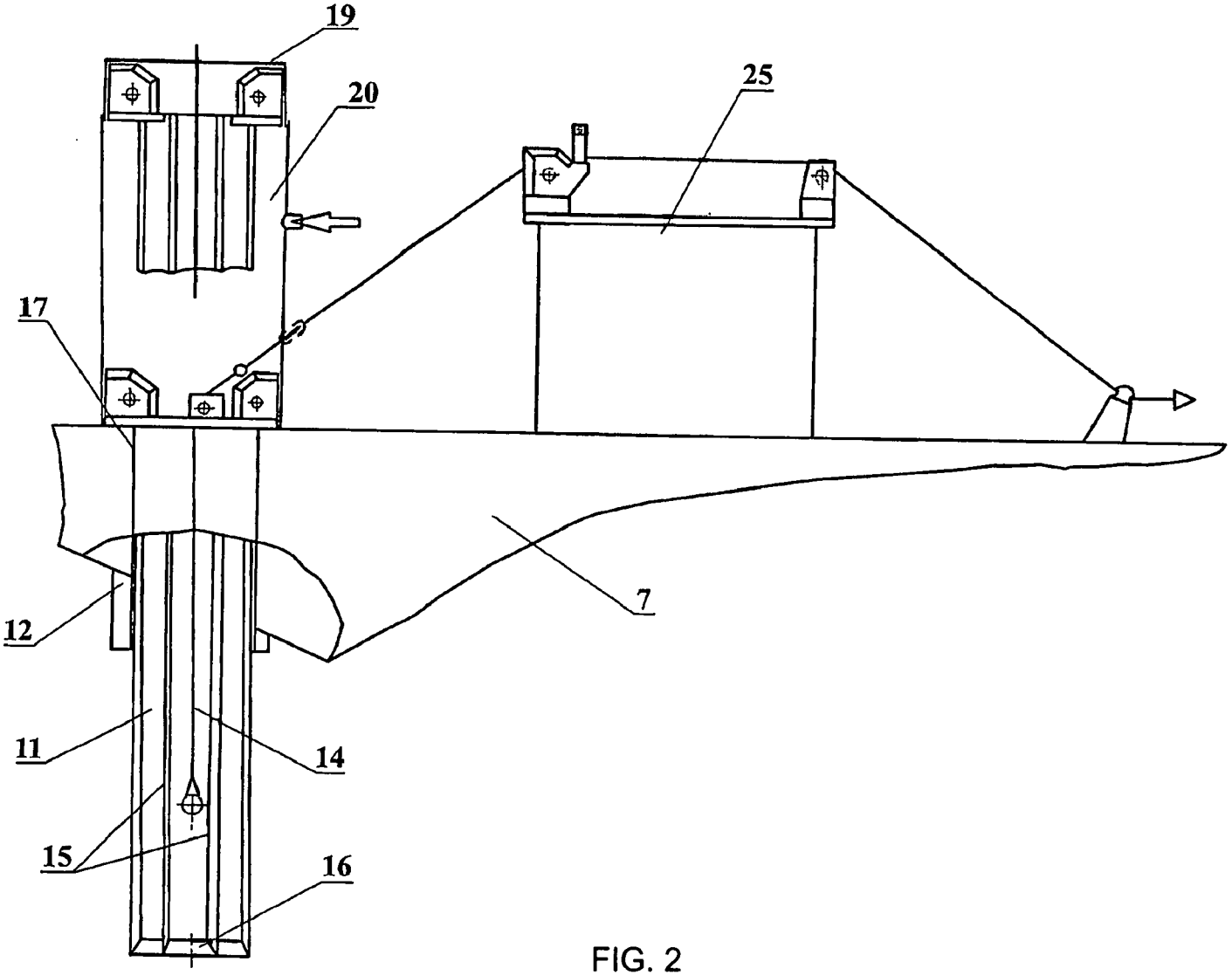
FIG. 2 shows the device for protecting the flexible hose of the pipeline, which is made in the form of a cylindrical tube (the scheme of raising and lowering the tubule)
Figure 3:
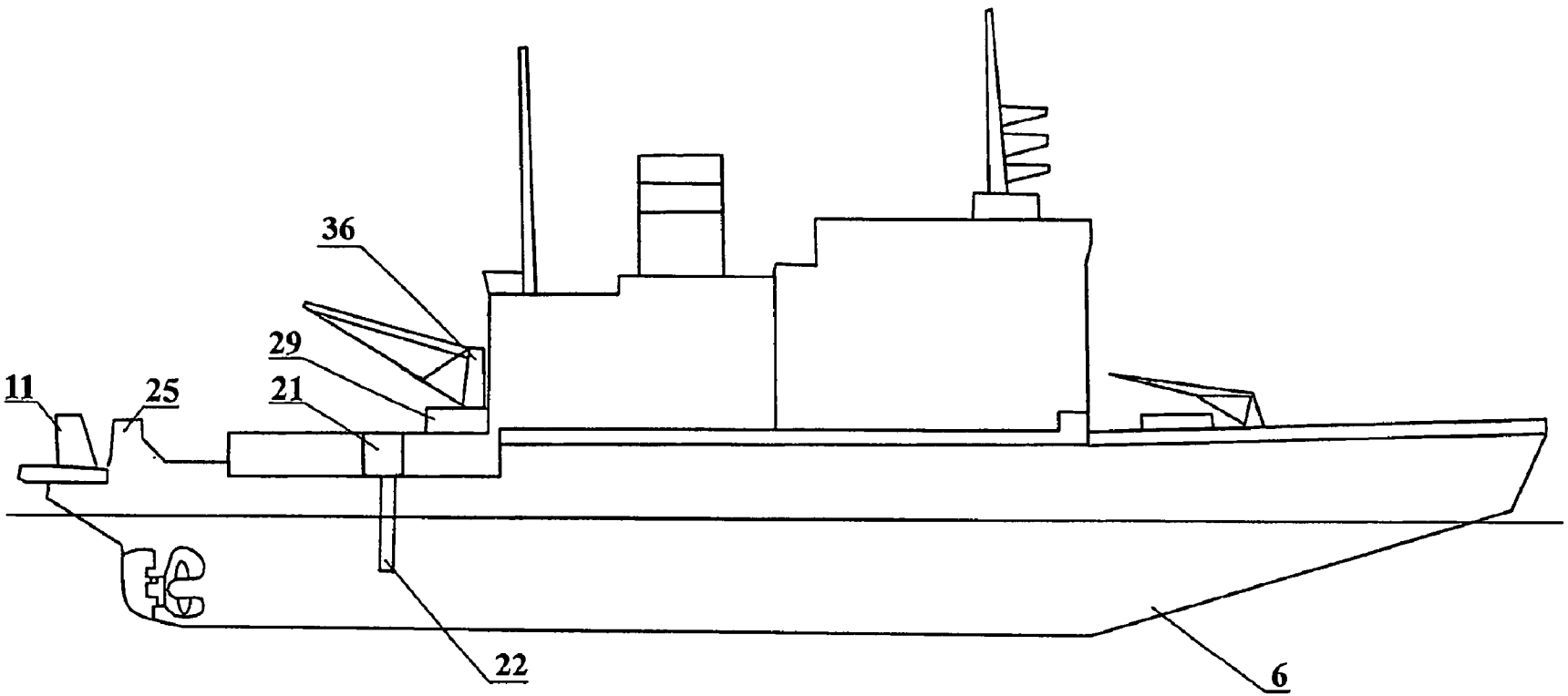
FIG. 3 shows the scheme of the ice-breaker, side view.

On the afterdeck of the ice-breaker 6 a device is arranged (see FIG. 2) made in the form of a cylinder 11 for the purpose of protecting the flexible hose 5 of the pipeline 3 from ice action during lowering and raising operations and during the operation of the complex for transferring oil from the pipeline 3 through the hose 5 to the tanker 1. In the hull of the stem side of the ice-breaker 6 the well 12 for servicing the said device is arranged. On the afterdeck of the ice-breaker 6 a lifting device is installed, which is made in the form of a capstan 13 (see FIGS. 5, 7) with the cable 14, the latter having the possibility of going through the service well 12. The cylinder 11 of the device for protecting the hose 5 is equipped with the guides 15 to be able to move in the service well 12. In the travel position the cylinder 11 is arranged and fixed on the afterdeck of the ice-breaker 6 (see FIGS. 3, 11), and in the operation position the cylinder 11 is lowered through well 12 (see FIGS. 2, 6) so as its lower side 16 is located lower than the base of floating ice at 0.5 m or 2 m below the design waterline of the ice-breaker 6. Proceeding from low operation temperatures, the material of the cylinder 11 is selected to be frost-resistant, e.g., RS E32.

The upper part 17 of the well 12 is provided with a device, e.g., the clamp 18 for fixing the flexible hose 5, and is made with a closing device, e.g., the removable cover 19. The latter is used in the travel position of the cylinder 11. The well 12 is provided with the device 20 preventing the well 12 and the cylinder 11 in the travel position from icing. The device 20 is made as a canvas bag with blasting hot air from the heating system of the ice-breaker 6.

On the deck of the ice-breaker 6 the diving station 21 (see FIG. 3) is installed, which is provided with the diving well 22 arranged in the hull of the ice-breaker 6 and intended for descending a diver.

Figure 4:
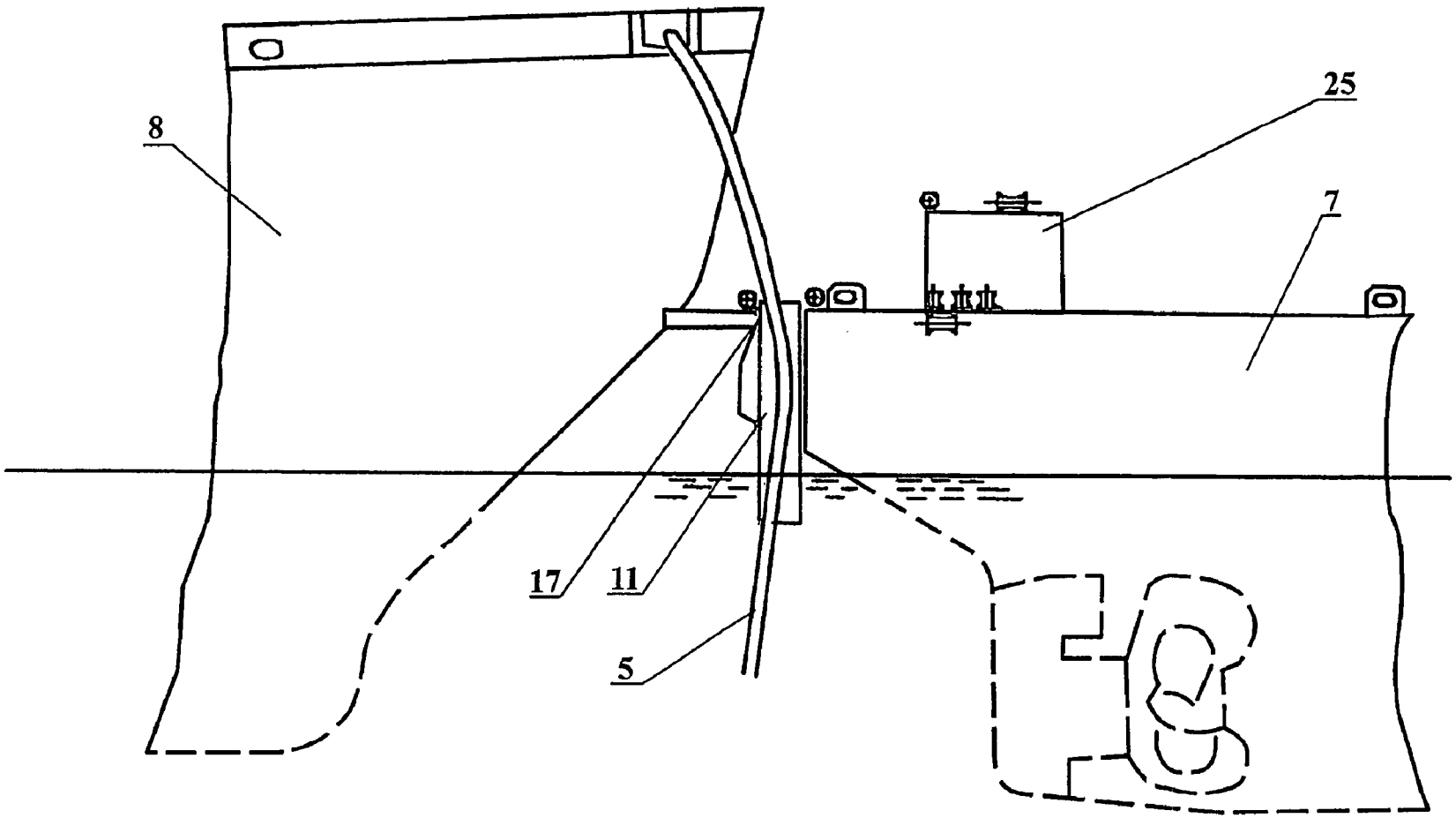
FIG. 4 shows the scheme of transferring the hose to a tanker through the tube of the ice-breaker when the tanker is located directly at the ice-breaker's stem, side view.

On the afterdeck of the ice-breaker 6 a handling device is arranged for transferring the flexible hose 5 from the ice-breaker 6 to the tanker 1 (see FIGS. 4, 5, 6 and 7). The handling device is made as a capstan 13 with the load-bearing cable 23. The tanker 1 is shown in FIGS. 4 and 5 as moored directly to the ice-breaker 6, and in FIGS. 6 and 7 it is moored at a distance not more than 15 meters.

The flexible hose 5 is equipped with a quickly detachable device 24 with the locking mechanism. On the afterdeck of the ice-breaker 6 the removable assembly platform 25 (see FIGS. 2, 3, 4, 5, 6, 7, 10 and 11) is installed, on which a reservoir (now shown) is installed for the purpose of collecting possible leakages of a liquid cargo while transferring the latter from the ice-breaker 6 to the tanker 1.

In the fore part 8 of the tanker 1 the manifold 26 (see FIGS. 5, 7) is installed together with the valve of the cargo pipeline (both are not shown). Attached to the manifold 26 is either the flexible hose 5 (for direct mooring of the tanker 1 to the ice-breaker 6), or the intermediate hose 27 equipped with the quickly detachable device 24 with the locking mechanism necessary for connecting to the hose 5. The intermediate hose 27 is required in cases where the tanker 1 is moored to the ice-breaker 6 at a distance and the length of the flexible hose 5 is insufficient. In the fore part 8 of the tanker 1 the mooring winch 28 is installed for carrying out mooring operations.

Second Embodiment

According to this embodiment, the device for protecting the flexible hose 5 of the pipeline 3 is made in the form of the pontoon 29 (see FIGS. 8, 9, 10, 11, 12) comprising the well 30 for servicing of the hose 5 and arranged in the travel position on the deck of the ice-breaker 6. The pontoon 29 has a square form and vertical sides 31. In the middle part of the pontoon 29 the well 30 with the diameter of app. 1 meter is arranged, the said well having the funnel-shaped opening 32 in its lower part. In order to ensure the required draft (2 meters), the lower part of the pontoon 29 is made permeable, the impermeable volume is limited from below by the second bottom 33 and subdivided into watertight compartments or filled with a foamed polymer.

For bleeding air from the permeable volume when the pontoon 29 is moved on sea the air tubes are provided for (not shown), which pass from the second bottom 33 up to the deck 34 of the pontoon 29; and for filling it with water openings in the bottom are provided for (not shown). For cargo handling operations with the pontoon 29 four eyes 35 are provided for. The pontoon 29 is welded from 10 mm thick steel plates. On the deck of the ice-breaker 6 the mechanism for lowering and raising the pontoon 29 from the ice-breaker 6 to sea and back, which mechanism is a ship cargo crane 36 (see FIG. 3). For the purpose of moving the pontoon 29 to the area of the underwater manifold 4 a service boat (not shown) is provided for at the ice-breaker 6, also the cargo capstans 13 of the ice-breaker 6 or the mooring winches 28 of the tanker 1 may be used.

The expansion—mooring of the pontoon 29 to the tanker 1 and the ice-breaker 6 is carried out with the use of the cables 37 (see FIGS. 11, 12).

The mobilization of the complex for shipping oil to a tanker and its operation is carried out as follows.

It is proposed that the claimed complex will be in temporary use, in individual cases, namely once in every 1–1.5 months, and the complex is created as a temporary structure for shipping oil in the winter time in the conditions of initial ice formation (finely broken ice having the thickness not exceeding 1.5 m).

The ice-breaker 6 comes to the area where the pipeline 3 with the manifold 4 is located, making the way through ice for the tanker 1. The ice-breaker 6 takes a position close to the longitudinal axis of the berth (see FIG. 1). Then, with the use of mooring lines and prismatic anchors 2 the ice-breaker 6 takes its position at the offshore berth. After this the tanker 1 independently moors with its fore side 8 to the stern 7 of the ice-breaker 6. The service boat 9, in her turn, moors with her stern to the stern 10 of the tanker 1 and comes on her own anchors. The service boat 9 takes a position, which should ensure holding the stem 10 of the tanker 1 against moving during the cargo handling operations. Moreover, the tanker 1 moors to the ice-breaker 6 directly or at a distance not exceeding 15 meters. The service boat 9 takes a position in 20–30 meters from the stem 10 of the tanker 1. After finishing the mooring operations, the preparations are carried out on the ice-breaker 6 for raising the flexible hose 5 of the pipeline 3. For this, with the use of the lifting mechanism from the diving station 21 and through the diving well 22 a diver is lowered in a diving cage. The diver searches for the flexible hose 5 located on the sea bed, connects the head of the hose 5 to the cable 14 and opens the valve of the underwater manifold 4.

First Embodiment

On the afterdeck of the ice-breaker 6 the cylinder 11 is positioned. For this, with the use of the cable 14 of the capstan 13, to which the cylinder 11 is connected, the said cylinder 11 is lowered along the guides 15 into the well 12 until its lower side 16 is lower than the base of floating ice in 0.5 m or 2 m below the design waterline of the ice-breaker 6. Then, the cable 14 is disconnected from the cylinder 11. After finding the hose 5 the diver connects the hose to the cable 14. The hose 5 is drawn through the cylinder 11 with the use of the capstan 13 onto the deck of the ice-breaker 6. The hose 5, owing to the cylinder 11, does not contact the surrounding ice, which prevents it from being damaged. The cylinder 11 will be at the operation position until completion of loading operations in the tanker 1. Owing to the work of the device 20, icing of the cylinder 11 and the well 12 is prevented, thus the reliable operation of the complex is ensured.

In the case where the tanker 1 is directly moored to the stem 7 of the ice-breaker 6 the flexible hose 5 is transferred to the tanker 1 with the use of the load-bearing cable 23 and the capstan 13, where the flexible hose 5 is connected to the cargo manifold 26 of the tanker. In the case where the tanker 1 and the ice-breaker 6 are at a distance from each other the length of the flexible hose 5 is insufficient, therefore the intermediate hose 27 is connected to the flexible hose 5 at the platform 25 with the use of quickly detachable connectors 24. Then the intermediate hose 27, being drawn by mooring winch 28 of the tanker 1 and held by the cable 23 of the capstan 13 of the ice-breaker 6, is transferred to the tanker 1.

On the tanker 1 the hose 5 (or the hose 27) is prepared for connecting to the cargo manifold 26 of the tanker 1 by removing from the hose 5 (or hose 27) the locking mechanism of the quickly detachable connector 24 and by connecting the hose 5 to the cargo pipeline of the tanker 1. After shipping the required quantity of oil to the tanker 1, the hose 5 of the underwater pipeline 3 (or the intermediate hose 27) is removed in the reverse order.

With the use of the cable 14 of the capstan 13 the hose 5 is lowered through the cylinder 11, bypassing ice, to the sea bed. The diver disconnects the cable 14 from the hose 5 and closes the valve of the underwater manifold 4.

According to the second embodiment of the claimed invention, the flexible hose 5 is lowered and raised and oil is shipped with the use of the pontoon 29 through its well 30, which protects the hose 5 of the pipeline 3 against floating ice when the hose is lowered to the sea bed and raised from it and during shipping oil. The pontoon 29 is used in the conditions of finely broken ice which thickness does not exceed 15 centimeters.

With the use of the ship cargo crane 36 of the ice-breaker 6 the pontoon 29 is lowered on the water. The latter is moved, either by the service boat of the ice-breaker 6 or with the use of the mooring mechanisms of the latter, to the area where the underwater manifold 4 is located. The diver raises the hose 5 from the sea bed. With the help of the diver, while using the capstan 13 with the cable 14 being connected to the hose 5, the latter is passed through the well 30 of the pontoon 29. Then the hose 5 is raised onto the ice-breaker 6 for the purpose of equipping it with the devices necessary for shipping oil (this is provided for in the case where the tanker 1 is moored directly to the stem of the ice-breaker 6). After this, the operations continue according to the first embodiment.

In the case where the tanker 1 is at a distance from the ice-breaker 6, the pontoon 29 together with the hose 5 is transported to the tanker 1 either by the service boat or with the use of the mooring mechanisms of the ice-breaker 6 and the mooring winches 28 of the tanker 1. The pontoon 29 is moored—connected to the tanker 1 and to the ice-breaker 6 by the cables 37. Then the oil shipping operations proceed according to the first embodiment.

The complex claimed as an invention enables to carry out works on loading oil to the tanker 1 not only in the conditions of initial ice formation, but also in the conditions of stable fast ice. The ice-breaker 6, independently making her way in fast ice or, if necessary, following a line nuclear-powered ice-breaker, e.g., of Taimyr type, comes to the area of the underwater manifold 4 and is fixed with the use of the ice anchors 2. The tanker 1 comes along the open water to the ice-breaker and casts two stern-side ice anchors. Then the fore of the tanker 1 is drawn to the stem 7 of the ice-breaker 6. After this the operations on lowering and raising the cylinder 11 (or the pontoon 29), raising the hose 5 and shipping oil are carried out as described above.

Thus, in the result of utilizing this invention, the possibility of achieving the technical result—to ensure offshore shipping of a liquid cargo, mainly oil, from the shore oil tank battery to sea-going tankers in the winter time in the conditions of initial ice formation and stable fast ice—is realized.

Consequently, the claimed complex for transferring a liquid cargo, mainly oil, to a tanker complies with the patentability criterion of industrial applicability.

At present a temporary offshore berth has been built on the base of re-equipped Ice-Breaker "Kapitan Nikolayev", Tanker "Astrakhan" and Towboat "Neftegaz"; this complex has passed the tests in the Barents Sea and in the Timano-Pechora region and has proved the possibility of shipping oil in the winter time.

What is claimed is:

1. A complex for transferring a liquid cargo to a tanker, comprising an offshore mooring berth with anchors, a transferring underwater pipeline with a manifold to which a flexible hose is connected for connecting the tanker with the underwater pipeline, a lifting device with a cable, a service well installed with the possibility of passing the cable of the said lifting device through it and with the possibility of access to its upper part, characterized in that the complex is equipped with an ice-breaker moored to the offshore berth, to the stern of which the tanker is moored with her fore directly or at a distance, a service boat installed on the stern side of the latter, and arranged in the ice-breaker's afterdeck a device for the protection of the pipeline flexible hose against ice action, a handling device for transferring the flexible hose from the ice-breaker to the tanker, and a diving well and a diving station, the said service well being arranged in the hull of the ice-breaker's stern side, the said device for the protection of the flexible hose being made in the form of a cylinder provided with guides for the possibility of moving inside the said service well and which lower edge in the operation position being arranged lower than the base of floating ice.

2. The complex according to claim 1, characterized in that the upper part of the well is equipped with a device for fixing the flexible hose, an anti-icing device, and in a travel position is made with a closing device, and the flexible hose is equipped with a quickly detachable device with a locking mechanism.

3. The complex according to claim 2, wherein said liquid cargo comprises oil.

4. The complex according to claim 1, wherein said liquid cargo comprises oil.

5. A complex for transferring a liquid cargo to a tanker, comprising an offshore mooring berth with anchors, a transferring underwater pipeline with a manifold to which a flexible hose is connected for connecting the tanker with the underwater pipeline, a lifting device with a cable, characterized in that the complex is equipped with an ice-breaker moored to the offshore berth, to the stern of which the tanker is moored with her fore directly or at a distance, a service boat installed on the stern side of the latter, a diving well and a diving station arranged in the hull of the ice-breaker, a device for protecting the flexible hose of the pipeline against icing, the said device being installed in a travel position on the deck of the ice-breaker and being made in the form of a pontoon having a well for servicing the said flexible hose.

6. The complex according to claim 5, characterized in that it is equipped with a mechanism, which is installed on the deck of the ice-breaker, for lowering and raising the said pontoon.

7. The complex according to claim 6, wherein said liquid cargo comprises oil.

8. The complex according to claim 5, wherein said liquid cargo comprises oil.

* * * * *